US010167675B2

(12) United States Patent
Long et al.

(10) Patent No.: US 10,167,675 B2
(45) Date of Patent: Jan. 1, 2019

(54) POLYCRYSTALLINE DIAMOND CUTTING ELEMENTS HAVING LEAD OR LEAD ALLOY ADDITIONS

(71) Applicant: DIAMOND INNOVATIONS, INC., Worthington, OH (US)

(72) Inventors: Christopher Allen Long, Westerville, OH (US); Andrew Gledhill, Westerville, OH (US)

(73) Assignee: Diamond Innovations, Inc., Worthington, OH (US)

( * ) Notice: Subject to any disclaimer, the term of this patent is extended or adjusted under 35 U.S.C. 154(b) by 410 days.

(21) Appl. No.: 14/707,278

(22) Filed: May 8, 2015

(65) Prior Publication Data

US 2016/0326809 A1 Nov. 10, 2016

(51) Int. Cl.
*E21B 10/567* (2006.01)
*E21B 10/573* (2006.01)
(Continued)

(52) U.S. Cl.
CPC ..... *E21B 10/567* (2013.01); *B22F 3/14* (2013.01); *B22F 3/24* (2013.01); *B22F 5/00* (2013.01); *B24D 3/10* (2013.01); *B24D 18/0009* (2013.01); *B24D 99/00* (2013.01); *C22C 11/00* (2013.01); *C22C 26/00* (2013.01); *E21B 10/5735* (2013.01); *B22F 3/15* (2013.01); *B22F 2005/001* (2013.01); *B22F 2301/30* (2013.01);
(Continued)

(58) Field of Classification Search
CPC ..... B24D 3/10; E21B 10/567
See application file for complete search history.

(56) References Cited

U.S. PATENT DOCUMENTS

2010/0199573 A1* 8/2010 Montross ..... C22C 26/00 51/307
2011/0061942 A1 3/2011 Digiovanni
(Continued)

FOREIGN PATENT DOCUMENTS

WO 2010128492 A1 11/2010

OTHER PUBLICATIONS

Schlumberger Oilfield Glossary entry for "PDC bit", accessed Oct. 12, 2017 via www.glossary.oilfield.slb.com.*
(Continued)

*Primary Examiner* — Blake E Michener

(57) ABSTRACT

Polycrystalline diamond cutting elements having enhanced thermal stability, drill bits incorporating the same, and methods of making the same are disclosed herein. In one embodiment, a cutting element includes a substrate having a metal carbide and a polycrystalline diamond body bonded to the substrate. The polycrystalline diamond body includes a plurality of diamond grains bonded to adjacent diamond grains by diamond-to-diamond bonds and a plurality of interstitial regions positioned between adjacent diamond grains. At least a portion of the plurality of interstitial regions comprise lead or lead alloy, a catalyst material, metal carbide, or combinations thereof. At least a portion of the plurality of interstitial regions comprise lead or lead alloy that coat portions of the adjacent diamond grains such that the lead or lead alloy reduces contact between the diamond and the catalyst.

21 Claims, 5 Drawing Sheets
(2 of 5 Drawing Sheet(s) Filed in Color)

(51) Int. Cl.

| | |
|---|---|
| ***B24D 3/10*** | (2006.01) |
| ***B22F 5/00*** | (2006.01) |
| ***B22F 3/14*** | (2006.01) |
| ***B24D 18/00*** | (2006.01) |
| ***B24D 99/00*** | (2010.01) |
| ***C22C 11/00*** | (2006.01) |
| ***C22C 26/00*** | (2006.01) |
| ***B22F 3/24*** | (2006.01) |
| *B22F 3/15* | (2006.01) |
| *C22C 27/04* | (2006.01) |
| *C22C 27/06* | (2006.01) |

(52) U.S. Cl.
CPC ..... *B22F 2302/406* (2013.01); *B22F 2303/30* (2013.01); *B22F 2998/10* (2013.01); *C22C 27/04* (2013.01); *C22C 27/06* (2013.01)

(56) References Cited

U.S. PATENT DOCUMENTS

| | | | | |
|---|---|---|---|---|
| 2012/0061149 | A1* | 3/2012 | Liversage | B22F 7/06 175/428 |
| 2012/0111642 | A1 | 5/2012 | Digiovanni | |
| 2014/0360791 | A1* | 12/2014 | Bowden | E21B 10/567 175/432 |
| 2014/0374172 | A1 | 12/2014 | Gledhill et al. | |
| 2015/0174733 | A1* | 6/2015 | Liversage | B22F 7/06 51/309 |

OTHER PUBLICATIONS

Dictionary definition of "interstice", accessed Mar. 26, 2018 via thefreedictionary.com.*

* cited by examiner

POLYCRYSTALLINE DIAMOND CUTTING ELEMENTS HAVING LEAD OR LEAD ALLOY ADDITIONS

CROSS-REFERENCE TO RELATED APPLICATIONS

None.

TECHNICAL FIELD AND INDUSTRIAL APPLICABILITY

The present disclosure relates generally to cutting elements made from superhard abrasive materials and, more particularly, to cutting elements made from polycrystalline diamond having a lead or lead alloy addition that surround the individual diamond grains, and methods of making the same.

BACKGROUND

Polycrystalline diamond ("PCD") compacts are used in a variety of mechanical applications, for example in material removal operations, as bearing surfaces, and in wire-drawing operations. PCD compacts are often used in the petroleum industry in the removal of material in downhole drilling. The PCD compacts are formed as cutting elements, a number of which are attached to drill bits, for example, roller-cone drill bits and fixed-cutting element drill bits.

PCD cutting elements typically include a superabrasive diamond layer, referred to as a polycrystalline diamond body, which is attached to a substrate. The polycrystalline diamond body may be formed in a high pressure high temperature (HPHT) process, in which diamond grains are held at pressures and temperatures to cause the diamond particles bond to one another.

As is conventionally known, the diamond particles are introduced to the HPHT process in the presence of a catalyst material that, when subjected to the conditions of the HPHT process, promotes formation of interparticle diamond bonds. The catalyst material may be embedded in a substrate, for example, a cemented tungsten carbide substrate having cobalt. The catalyst material may infiltrate the diamond particles from the substrate. Following the HPHT process, the diamond particles are sintered to one another and may be attached to the substrate.

While the catalyst material promotes formation of the inter-diamond bonds during the HPHT process, the presence of the catalyst material in the sintered diamond body after the completion of the HPHT process may also reduce the stability of the polycrystalline diamond body at elevated temperatures. Some of the diamond grains may undergo a back-conversion to a softer non-diamond form of carbon (for example, graphite or amorphous carbon) at elevated temperatures. Further, mismatch of the thermal expansion of the materials may induce stress into the diamond lattice causing microcracks in the diamond body. Back-conversion of diamond and stress induced by the mismatch of thermal expansion of the materials may contribute to a decrease in the toughness, abrasion resistance, and/or thermal stability of the PCD cutting elements during operation.

Accordingly, polycrystalline diamond cutting elements that have improved thermal stability may be desired.

SUMMARY

In one embodiment, a cutting element includes a substrate having a metal carbide and a polycrystalline diamond body bonded to the substrate. The polycrystalline diamond body includes a plurality of diamond grains bonded to adjacent diamond grains by diamond-to-diamond bonds and a plurality of interstitial regions positioned between adjacent diamond grains. At least a portion of the plurality of interstitial regions include lead or lead alloy where lead is present in an amount of at least about 90 wt. % of the lead alloy, a catalyst material, metal carbide, or combinations thereof. At least a portion of the plurality of interstitial regions include lead or lead alloy that coat portions of the adjacent diamond grains such that the lead or lead alloy reduces contact between the diamond and the catalyst.

In another embodiment, a polycrystalline diamond volume includes a plurality of diamond grains bonded to adjacent diamond grains by diamond-to-diamond bonds forming a continuous diamond matrix and a plurality of interstitial regions positioned between adjacent diamond grains and forming a continuous interstitial matrix. At least a portion of the continuous interstitial matrix includes catalyst material that is separated from the diamond grains by lead or lead alloy where lead is present in an amount of at least about 90 wt. % of the lead alloy such that the lead or lead alloy reduces contact between the diamond and the catalyst material.

In yet another embodiment, a cutting element includes a substrate that includes a metal carbide and a polycrystalline diamond body bonded to the substrate. The polycrystalline diamond body includes a plurality of diamond grains bonded to adjacent diamond grains by diamond-to-diamond bonds forming a continuous diamond matrix and a plurality of interstitial regions positioned between adjacent diamond grains and forming a continuous interstitial matrix. At least a portion of the continuous interstitial matrix includes catalyst material that is separated from the diamond grains by lead or lead alloy, where lead is present in an amount of at least about 90 wt. % of the lead alloy, such that the lead or lead alloy reduces contact between the diamond and the catalyst material.

In yet another embodiment, a method of forming a cutting element includes assembling a reaction cell comprising a plurality of diamond particles, lead or lead alloy having lead present in an amount of at least about 90 wt. % of the lead alloy, a catalyst material, and a substrate within a refractory metal container. The method further includes subjecting the reaction cell and its contents to a high pressure high temperature sintering process to form a continuous diamond volume. The diamond particles are compacted into a densified unbonded diamond region in which at least some of the diamond particles are separated by interstitial regions. The lead or lead alloy is melted and is present in a liquid state in at least some of the interstitial regions between diamond particles. The catalyst material is melted and is present in at least some of the interstitial regions between the individual diamond grains, where the catalyst material promotes formation of diamond-to-diamond bonds between adjacent diamond particles. The lead or lead alloy coats surfaces of at least a portion of the plurality of diamond particles after the high pressure high temperature sintering operation is completed.

In yet another embodiment, a drill bit includes a material removal portion having a plurality of shanks. The material removal portion having an axis of rotation that is relative to a base portion. The drill bit also includes at least one cutting element that is bonded to the material removal portion at one of the plurality of shanks. The cutting elements include a substrate comprising a metal carbide and a polycrystalline diamond body bonded to the substrate. The polycrystalline diamond body includes a plurality of diamond grains bonded to adjacent diamond grains by diamond-to-diamond bonds and a plurality of interstitial regions positioned between adjacent diamond grains. At least a portion of the plurality of interstitial regions include lead or lead alloy where lead is present in an amount of at least about 90 wt. % of the lead alloy, a catalyst material, metal carbide, or combinations thereof. At least a portion of the plurality of interstitial regions include lead or lead alloy that coat portions of the adjacent diamond grains such that the lead or lead alloy reduces contact between the diamond and the catalyst.

BRIEF DESCRIPTION OF THE DRAWINGS

The patent or application file contains at least one photomicrograph executed in color. Copies of this patent or patent application publication with color photomicrographs will be provided by the Office upon request and payment of the necessary fee.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
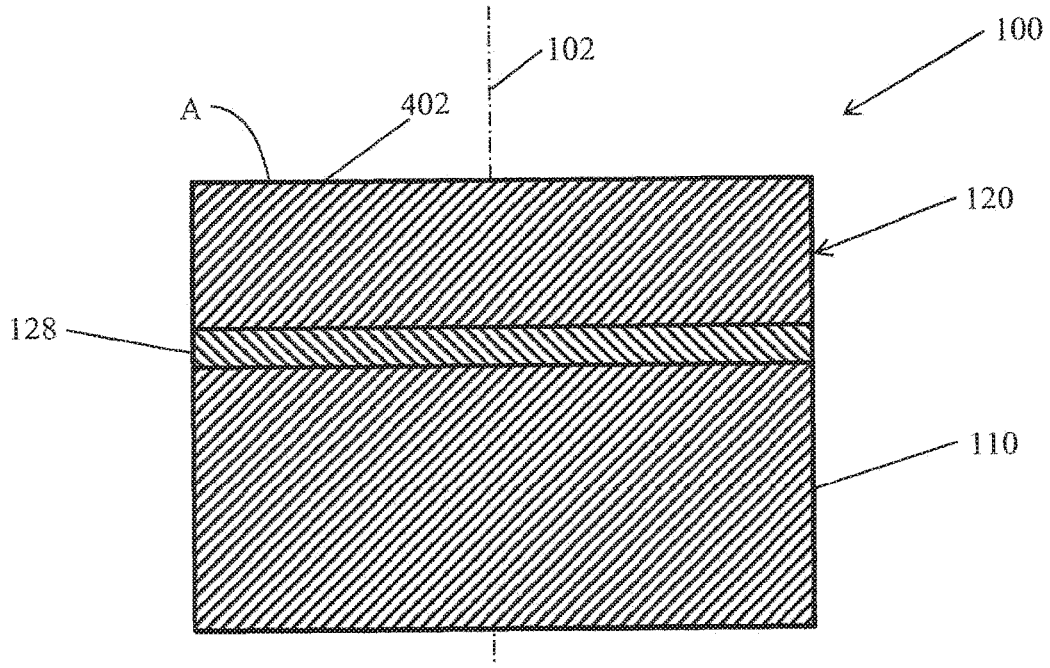
FIG. 1 is a schematic side cross-sectional view of a PCD cutting element according to one or more embodiments shown or described herein.

The present disclosure is directed to polycrystalline diamond cutting elements having enhanced thermal stability, drill bits incorporating the same, and methods of making the same. A cutting element may include a substrate and a polycrystalline diamond body bonded to the substrate. The polycrystalline diamond body may include a plurality of diamond grains bonded to adjacent diamond grains by diamond-to-diamond bonds and a plurality of interstitial regions positioned between adjacent diamond grains. At least a portion of the plurality of interstitial regions include lead or lead alloy that coat portions of the adjacent diamond grains such that the lead or lead alloy reduces contact between the diamond and the catalyst introduced to aid in sintering of the diamond particles. Polycrystalline diamond cutting elements having enhanced thermal stability, drill bits incorporating the same, and methods of making the same are described in greater detail below.

It is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the end user. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the value of the number with which it is being used. Therefore, "about 40" means in the range of 36-44. As used herein, all numerical values should be interpreted to include "about" prior to their recitation.

Polycrystalline diamond compacts (or "PCD compacts", as used hereafter) may represent a volume of crystalline diamond grains with embedded non-diamond material filling the inter-granular spaces. In one example, a PCD compact includes a plurality of crystalline diamond grains that are bonded to each other by strong interparticle diamond bonds and forming a continuous polycrystalline diamond body, and the inter-granular regions, disposed between the bonded grains and filled with a non-diamond material (e.g., a catalyst material such as cobalt or its alloys), which was used to promote diamond bonding during fabrication of the PCD compact. Suitable metal solvent catalysts may include the metal in Group VIII of the Periodic table. Polycrystalline diamond cutting elements (or "PCD cutting element", as is used hereafter) include the above mentioned polycrystalline diamond body attached to a suitable substrate (for example, cemented tungsten carbide-cobalt (WC—Co)). The attachment between the polycrystalline diamond body and the substrate may be made by virtue of the presence of a catalyst, for example cobalt metal. In another embodiment, the polycrystalline diamond body may be attached to the substrate by brazing. In another embodiment, a PCD compact includes a plurality of crystalline diamond grains that are strongly bonded to each other by a hard amorphous carbon material, for example a-C or t-C carbon. In another embodiment, a PCD compact includes a plurality of crystalline diamond grains, which are not bonded to each other, but instead are bound together by foreign bonding materials such as borides, nitrides, or carbides, for example, SiC.

As discussed above, conventional PCD cutting elements are used in a variety of industries and applications in material removal operations. PCD cutting elements are typically used in non-ferrous metal removal operations and in downhole drilling operations in the petroleum industry. Conventional PCD cutting elements exhibit high toughness, strength, and abrasion resistance because of the inter-granular inter-diamond bonding of the diamond grains that make up the polycrystalline diamond bodies of the PCD cutting elements. The inter-diamond bonding of the diamond grains of the polycrystalline diamond body are promoted during an HPHT process by a catalyst material. However, at elevated temperature, the catalyst material and its byproducts that remain present in the polycrystalline diamond body after the HPHT process may promote back-conversion of diamond to non-diamond carbon forms and may induce stress into the diamond lattice due to the mismatch in the thermal expansion of the materials. The performance of the PCD cutting element at elevated temperature may be referred to as the "thermally stable" performance of the cutting element.

It is conventionally known to remove or deplete portions of the catalyst material to improve the thermal stability of the diamond body. The most common method of removing the catalyst material is a leaching process in which the PCD compact is introduced to a leaching agent, for example, an aqueous acid solution. The leaching agent may be selected from a variety of conventionally-known compositions in which the catalyst material is known to dissolve. By dissolving and removing at least a portion of the catalyst material from the PCD compact, the service life of the PCD compact may be increased due to the reduction in back-conversion rate of the diamond in the polycrystalline diamond body to non-diamond carbon forms and the reduction in materials having mismatched thermal expansion. However, a portion of catalyst material may still remain in the diamond body of the PCD compact that have been subjected to the leaching process. The interstitial regions between diamond grains may form "trapped" or "entrained" volumes into which the leaching agent has limited or no accessibility. Therefore, these trapped volumes remain populated with the constituents of the PCD formation process. The trapped volumes that contain catalyst material contribute to the degradation of the abrasion resistance of the PCD cutting element at elevated temperature that is generated during use of the PCD cutting element to remove material. Thus, reduction of trapped catalyst material may improve the abrasion resistance of PCD compact cutting elements.

The present disclosure is directed to polycrystalline diamond cutting elements that incorporate lead or lead alloy that is distributed throughout the polycrystalline diamond body. In one embodiment, the lead or lead alloy may be lead or lead alloy having at least about 90 wt. % lead. The lead or lead alloy may be introduced to the diamond particles prior to or concurrently with the HPHT process. The lead or lead alloy may be distributed throughout the polycrystalline diamond body evenly or unevenly, as well as by forming a distribution pattern. The lead or lead alloy may reduce the amount of catalyst material that is present in the polycrystalline diamond body following the HPHT process. Further, the lead or lead alloy may reduce the amount of catalyst material that is present in the polycrystalline diamond body following a leaching process in which at least portions of both the lead or lead alloy and the catalyst material are removed from the interstitial regions of the polycrystalline diamond body. Additionally, the lead or lead alloy may increase the removal rate (or the "leaching rate") of the catalyst material from the polycrystalline diamond body. In some embodiments, the lead or lead alloy coats the diamond grains, thereby maintaining a spacing between the catalyst material and the diamond grains for a plurality of diamond grains in the diamond body.

Because of the reduction of the catalyst material in the polycrystalline diamond body and because of the separation between the diamond grains and the catalyst material, polycrystalline diamond cutting elements according to the present disclosure exhibit performance that exceeds that of conventional PCD cutting elements in at least one of toughness, strength, and abrasion resistance.

Figure 2:
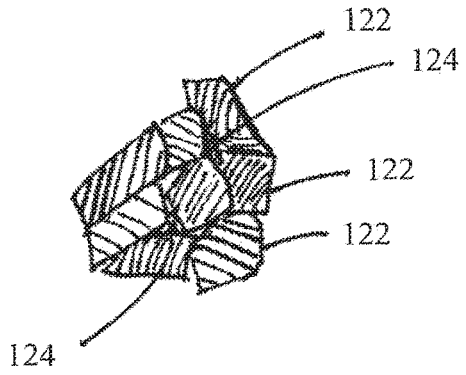
FIG. 2 is a detailed schematic side cross-sectional view of the PCD cutting element of FIG. 1A shown at location A.

Referring now to FIGS. 1 and 2, a PCD cutting element 100 is depicted. The PCD cutting element 100 includes a substrate 110 and a polycrystalline diamond body 120 that is attached to the substrate 110. The polycrystalline diamond body 120 includes a plurality of diamond grains 122 that are bonded to one another, including being bonded to one another through inter-diamond bonding. The bonded diamond grains 122 form a diamond lattice that extends along the polycrystalline diamond body 120. The diamond body 120 also includes a plurality of interstitial regions 124 between the diamond grains. The interstitial regions 124 represent a space between the diamond grains. In at least some of the interstitial regions 124, a non-carbon material is present. In some of the interstitial regions 124, lead or lead alloy is present. In other interstitial regions 124, catalyst material is present. In yet other interstitial regions 124, both lead or lead alloy and catalyst material are present. In yet other interstitial regions 124, at least one of catalyst material, lead or lead alloy, swept material of the substrate 110, for example, cemented tungsten carbide, and reaction byproducts of the HPHT process are present. Non-carbon, lead or lead alloy, or catalyst materials may be bonded to diamond grains. Alternatively, non-carbon, lead or lead alloy, or catalyst materials may be not bonded to diamond grains.

The catalyst material may be selected from a variety of materials that interact with the diamond particles to form interparticle diamond bonds. Examples of such materials include, for example and without limitation, elemental metallic catalyst such as elements selected from Group VIII of the periodic table, for example, cobalt, nickel, iron, or alloys thereof, as well as magnesium, chromium, tantalum, and niobium, metallic alloy catalysts selected Group IV, V, or VI of the periodic table alloyed with silver, copper, or gold, alkaline and alkaline earth compounds or carbonates thereof, and non-metallic elemental catalysts such as phosphorus and sulphur. The catalyst material may be present in a greater concentration in the substrate 110 than in the polycrystalline diamond body 120, and may promote attachment of the substrate 110 to the polycrystalline diamond body 120 in the HPHT process, as will be discussed below. The polycrystalline diamond body 120 may include an attachment region 128 that is rich in catalyst material promotes bonding between the polycrystalline diamond body 120 and the substrate 110. In other embodiments, the concentration of the catalyst material may be greater in the polycrystalline diamond body 120 than in the substrate 110. In yet other embodiments, the catalyst material may differ from the catalyst of the substrate 110. The catalyst material may be a metallic catalyst reaction-byproduct, for example catalyst-carbon, catalyst-tungsten, catalyst-chromium, or other catalyst compounds, which also may have lower catalytic activity towards diamond than a metallic catalyst.

The lead or lead alloy may be selected from a variety of materials that are non-catalytic with the carbon-diamond conversion. The lead or lead alloy may be generally immiscible with the catalyst material when both are liquid such that the lead or lead alloy and the catalyst material do not alloy with one another when both are liquid. In some embodiments, the lead or lead alloy may have a lower liquidus or melting temperature than the liquidus or melting temperature of the catalyst material.

Both lead or lead alloy and catalyst material may be present in a detectable amount in the polycrystalline diamond body of the PCD cutting element both before and after subjecting the polycrystalline diamond body to leaching. Presence of such materials may be identified by X-ray fluorescence, for example using a XRF analyzer available from Bruker AXS, Inc. of Madison, Wis., USA. Presence of such material may also be identified using X-ray diffraction, energy dispersive spectroscopy, or other suitable techniques.

The lead or lead alloy may be introduced to the unbonded diamond particles prior to the HPHT process that bonds the diamonds particles in an amount that is in a range from about 0.1 vol. % to about 5 vol. % of the diamond body 120, for example an amount that is in a range from about 0.2 vol. % to about 4 vol. % of the diamond body 120, for example an amount that is in a range from about 0.5 vol. % to about 3 vol. %. In an exemplary embodiment, lead or lead alloy may be introduced to the unbonded diamond in an amount from about 0.33 to about 1.5 vol. %. Following this HPHT process and leaching, the lead or lead alloy content in the leached region of the diamond body 120 is reduced by at least about 50%, including being reduced in a range from about 50% to about 90%.

In the HPHT process that bonds the diamond particles, catalyst material may be introduced to the diamond powders. The catalyst material may be present in an amount that is in a range from about 0.1 vol. % to about 30 vol. % of the diamond body 120, for example an amount that is in a range from about 0.3 vol. % to about 10 vol. % of the diamond body 120, including being an amount of about 5 vol. % of the diamond body 120. In an exemplary embodiment, catalyst material may be introduced to the unbonded diamond is an amount from about 4.5 vol. % to about 6 vol. %. Following this HPHT process and leaching, the catalyst material content in the leached region of the diamond body 120 is reduced by at least about 50%, including being reduced in a range from about 50% to about 90%.

The lead or lead alloy and the catalyst material may be non-uniformly distributed in the bulk of the polycrystalline diamond cutting element 100 such that the respective concentrations of lead or lead alloy and catalyst material vary at different positions within the polycrystalline diamond body 120. In one embodiment the lead or lead alloy may be arranged to have a concentration gradient that is evaluated along a longitudinal axis 102 of the polycrystalline diamond cutting element 100. The concentration of the lead or lead alloy may be higher at positions evaluated distally from the substrate 110 than at positions evaluated proximally to the substrate 110. In opposite, the concentration of the catalyst material may be greater at positions evaluated proximally to the substrate 110 that at positions evaluated distally from the substrate 110. In yet another embodiment, the concentrations of the lead or lead alloy and the catalyst material may undergo a step change when evaluated in a longitudinal axis 102 of the polycrystalline diamond cutting element 100. In yet another embodiment, the concentrations of the lead or lead alloy and the catalyst material may exhibit a variety of patterns or configurations. Independent of the concentration of the lead or lead alloy and the catalyst material in the polycrystalline diamond body 120, however, both lead or lead alloy and catalyst material may be detectible along surfaces proximately and distally located relative to the substrate 110.

In another embodiment, the polycrystalline diamond body 120 may exhibit relatively high amounts of the catalyst material at positions proximate to the substrate 110 and at which the catalyst material forms a bond between the polycrystalline diamond body 120 and the substrate 110. In some embodiments, at positions outside of such an attachment zone, the lead or lead alloy and the catalyst material maintain the concentration variation described above.

PCD cutting elements 100 according to the present disclosure may exhibit improved performance as compared to conventionally produced PCD cutting elements when evaluated in terms of abrasion resistance and/or toughness. The performance of PCD cutting elements 100 according to the present disclosure may particularly exhibit improved performance when subjected to conditions of elevated temperature. Such conditions may occur when the PCD cutting elements 100 are used in material removal operations, for example, downhole drilling operations in the petroleum industry. Performance of the PCD cutting element 100 with respect to abrasion resistance may be quantified in laboratory testing, for example using a simulated cutting operation in which the PCD cutting element 100 is used to machine an analogous material that replicates an end user application.

In one example used to replicate a downhole drilling application, the PCD cutting element 100 is held in a vertical turret lathe ("VTL") to machine granite. Parameters of the VTL test may be varied to replicate desired test conditions. In one example, the cutting element that is subjected to the VTL test is water cooled. In one example, the PCD cutting element 100 was positioned to maintain a depth of cut of about 0.017 inches/pass at a cross-feed rate of about 0.17 inches/revolution and a cutting element velocity of 122 surface feet per minute and a backrake angle of 15 degrees. The VTL test introduces a wear scar into the PCD cutting element 100 along the position of contact between the PCD cutting element 100 and the granite. The size of the wear scar is compared to the material removed from the granite to evaluate the abrasion resistance of the PCD cutting element 100. The service life of the PCD cutting element 100 may be calculated based on the material removed from the granite as compared to the size of the wear scar abrades through the polycrystalline diamond body 120 and into the substrate 110.

In another example, the PCD cutting element 100 is subjected to an interrupted milling test that implements a fly cutting tool holder and workpiece arrangement in which the PCD cutting element 100 is periodically removes material from a workpiece and then is brought out of contact with the workpiece. The interrupted milling test is described in U.S. patent application Ser. No. 13/791,277, the entire disclosure of which is hereby incorporated by reference. The interrupted milling test may evaluate thermal resistance of the PCD cutting element 100.

In some embodiments, PCD cutting elements 100 according to the present disclosure exhibit increased abrasion resistance as compared to conventionally produced PCD cutting elements. In some embodiments, PCD cutting elements 100 according to the present disclosure may exhibit at least about 30% less wear with an equivalent amount of material removed from the granite as compared to conventionally produced PCD cutting elements, including exhibiting about 75% less wear than a conventional cutting element, including exhibiting about 90% less wear than a conventional cutting element.

PCD cutting elements 100 according to the present disclosure exhibit a lower concentration of catalyst material in trapped interstitial regions between the bonded diamond grains as compared to conventionally processed cutting elements. As discussed above, because the catalyst material that is positioned within the trapped interstitial regions may contribute to back-conversion of the diamond grains to non-diamond forms of carbon. The propensity of the polycrystalline diamond body 120 of the PCD cutting element 100 to back-convert to non-diamond forms of carbon and/or the stress induced to the polycrystalline diamond body 120 by the mismatch in thermal expansion of co joined material may be correlated to the high-temperature abrasion resistance of the PCD cutting element 100. Reducing the amount of the catalyst material within the trapped interstitial regions between diamond grains of the polycrystalline diamond body 120 may reduce the rate of back-conversion of the PCD cutting element 100. Further, reducing the amount of catalyst material within the trapped interstitial regions between diamond grains of the polycrystalline diamond body 120 may reduce stress that is induced into the diamond lattice caused by a mismatch in the thermal expansion of the diamond grains and the catalyst material. Therefore, the reduction in the catalyst material within the trapped interstitial regions between the diamond grains resulting from the introduction of lead or lead alloy into the polycrystalline diamond body 120, improves performance of the PCD cutting element 100 as compared to conventionally produced PCD cutting elements.

Still referring to FIG. 1, some embodiments of the PCD cutting element 100 include a crown portion 402 that is positioned within the polycrystalline diamond body 120 and along a surface opposite the substrate 110. The crown portion 402 is made from a material that is dissimilar from the material of the polycrystalline diamond body 120 and the substrate 110. The crown portion 402 may extend into the diamond body 120 from the top surface of the PCD cutting element 100. The crown portion 402 may extend to a depth that is less than about 1 mm from the substrate 110 including being about 300 μm from the substrate 110. The crown portion 402 may limit the depth that the catalyst material 94 sweeps into the polycrystalline diamond body 120 from the second substrate 110 during the second HPHT process. The crown portion 402 may provide locally modified material properties of the PCD cutting element 100. In one embodiment, the crown portion 402 may include, in addition to the bonded diamond grains and the lead or lead alloy and the catalyst material in detectable amounts, a material selected from the group consisting of aluminum, aluminum carbide, silicon, and silicon carbide. In some embodiments, the polycrystalline diamond body 120 may be free of such materials outside of the attachment region 128.

PDC cutting elements according to the present disclosure may be fabricated using so-called "single press" or "double press" HPHT process. In a single press HPHT process, diamond particles may be subjected to a high pressure high temperature sintering process in which diamond particles are subjected to elevated pressure to form an unbonded diamond volume having a plurality of diamond particles that contact one another and a plurality of interstitial regions positioned between adjacent diamond particles. Lead or lead alloy is melted and collects in interstitial regions. In some embodiments, the lead or lead alloy may be mixed with the diamond particles prior to initiation of the HPHT process. In other embodiments, the lead or lead alloy may be swept into the interstitial regions between the diamond particles during the HPHT process from an external source. In yet other embodiments, the lead or lead alloy may be both mixed with the diamond particles prior to initiation of the HPHT process and swept into the interstitial regions between the diamond particles during the HPHT process from an external source. The volume of lead or lead alloy introduced to the diamond particles may be less than the total volume of the interstitial regions of the diamond region, such that the lead or lead alloy present in the diamond volume cannot fill all of the interstitial regions between adjacent diamond grains.

Subsequent to melting of the lead or lead alloy, the catalyst material may be melted. The lead or lead alloy and the catalyst material may be selected such that the melting or liquidus temperature of the lead or lead alloy is lower than the melting or liquidus temperature of the catalyst material. In some embodiments, the melting or liquidus temperature of the lead or lead alloy may be lower than the solidus temperature of the catalyst material. In some embodiments, the catalyst material may be mixed with the diamond particles prior to initiation of the HPHT process. In other embodiments, the catalyst material may be swept into the interstitial regions between the diamond particles during the HPHT process from an external source, for example a substrate having a hard metal composition that includes a metal carbide and a catalyst material. In yet other embodiments, the catalyst material may be both mixed with the diamond particles prior to initiation of the HPHT process and swept into the interstitial regions between the diamond particles during the HPHT process from an external source. The components of the reaction cell may be maintained at a sintering temperature at which the diamond particles, aided by the catalyst material, form diamond-to-diamond bonds between adjacent diamond particles. In some embodiments, the lead or lead alloy may exhibit a lower viscosity than the viscosity of the catalyst material at the sintering temperature of the HPHT process. The catalyst material may be forced through the interstitial regions between diamond particles by the elevated pressure at which the components of the reaction cell are held. The volume and composition of the catalyst material may displace portions of the lead or lead alloy from the interstitial regions between diamond particles, thereby pushing lead or lead alloy away from many surfaces of the diamond particles.

With the catalyst material molten in a liquid state, the catalyst may dissolve at least a portion of the carbon from the diamond particles. As is conventionally known, the molten catalyst material may act as a solvent catalyst that, when cooled, diamond may re-precipitate from, such that the diamond particles form diamond-to-diamond bonds between one another, thereby forming a polycrystalline diamond body. The polycrystalline diamond body includes a plurality of diamond grains that are coupled to one another through diamond-to-diamond bonds, and having a plurality of interstitial regions positioned therebetween. The diamond grains that are bonded to one another may form an interconnected continuous diamond matrix of diamond grains. Most of the interstitial regions between the diamond grains are connected to one another such that the interstitial regions form an interconnected continuous matrix of interstitial regions. However, some of the interstitial regions within the polycrystalline diamond body may be "trapped" such that they are separated from the interconnected continuous matrix of interstitial regions. The polycrystalline diamond body may be attached to a substrate. Following the HPHT process, the trapped interstitial regions and the continuous interstitial matrix between the diamond grains may be filled with lead or lead alloy, catalyst material, hard metal, or combinations thereof.

In such embodiments, the catalyst material that is present in the trapped interstitial regions and/or the continuous interstitial matrix may be spaced apart from the diamond grains in the continuous diamond matrix by the lead or lead alloy. This result is surprising, because the catalyst material is generally better at "wetting" the surfaces of the diamond particles than any lead or lead alloy that is present in the diamond region. Further, in embodiments according to the present disclosure, some surfaces of the diamond grains may be coated by the lead or lead alloy, such that spacing between the diamond grains and the catalyst material is preserved following the HPHT process.

As conventionally known, the diamond body may be contacted with a leaching agent that removes at least a portion of the materials present in the interstitial regions that are positioned proximate to the location of leaching agent application. For example, the polycrystalline diamond body may be submerged in a leaching agent such that surfaces of the polycrystalline diamond body contact the leaching agent, while surfaces of the substrate, to which the polycrystalline diamond body are attached, are maintained spaced apart from contact with the leaching agent. The leaching agent may be selected to attack the lead or lead alloy and the catalyst material while preserving the diamond grains.

The lead or lead alloy and the catalyst material may undergo an oxidation-reduction reaction with the leaching agent. The lead or lead alloy may be more reactive with the leaching agent than the catalyst material such that the rate of the leaching reaction per unit distance within the diamond body is faster for diamond bodies formed with lead or lead alloy and catalyst material as compared to diamond bodies formed without the introduction of lead or lead alloy. The lead or lead alloy may exhibit a lower activation energy than the catalyst material with the leaching agent such that the rate of reaction is greater for the lead or lead alloy than the catalyst material.

The incorporation of lead or lead alloy into the diamond body during the HPHT process may result in a decrease in the total catalyst content both prior to and following leaching as compared to conventional cutting elements that do not include lead or lead alloy. The decrease in catalyst content as compared to conventional cutting elements may increase cutting element life by decreasing internal mechanical stresses attributable to mismatch between the coefficients of thermal expansion and modulus of the diamond grains, the lead or lead alloy, and the catalyst material, and any back-conversion to non-diamond forms of carbon, which may be accelerated due to the presence of catalyst material. Further, the increase in leaching rate may reduce manufacturing time associated with producing a cutting element according to embodiments disclosed herein, in particular, by reducing the cycle time associated with leaching the lead or lead alloy and catalyst material from the interstitial regions of the diamond body.

Additionally, the incorporation of lead or lead alloy into the diamond body during the HPHT process may result in a decrease in the hard metal concentration in the diamond body as compared to conventional diamond bodies made without the introduction of lead or lead alloy. Hard metals are typically introduced to the diamond bodies during the HPHT process from the substrate. In one embodiment, the hard metal concentration within diamond bodies according to the present disclosure may be less than 70% of the hard metal concentration of a conventional diamond body, for example being less than about 50% of the hard metal concentration of a conventional diamond body.

Figure 3:
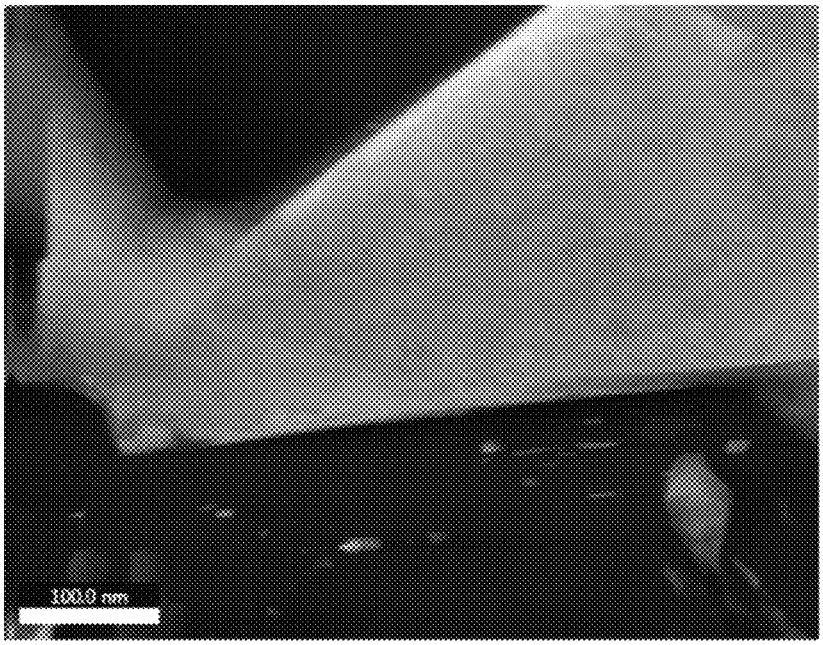
FIG. 3 is a transmission electron micrograph of a cutting element according to one or more embodiments shown or described herein.

Further, the incorporation of the lead or lead alloy to the polycrystalline diamond body may modify the microstructural configuration of the polycrystalline diamond body as compared to conventional polycrystalline diamond cutting elements. Referring now to FIG. 3, a transmission electron micrograph of the microstructure of a polycrystalline diamond cutting element that is manufactured according to the present disclosure is depicted. In this embodiment, lead particles were mixed with the diamond particles prior to positioning the diamond particles in the refractory cup for manufacturing. Lead particles were added at a concentration of about 0.5 wt. % of the lead-diamond mixture. The substrate included cemented tungsten carbide with about 12.5 wt. % cobalt, which acted as the catalyst in the HPHT process for sintering the diamond particles. The contents of the cell assembly used to manufacture the cutting element was subjected to a maximum temperature of about 1550° C. and a maximum pressure of 7.5 GPa, and were held above the melting temperature of cobalt for about 3 minutes. The PCD compact recovered from the HPHT process was further processed according to conventionally known procedures to a shape of a cutting element.

Following this processing, portions of the diamond volume were removed and prepared as a sample for the transmission electron microscopy. The sample of the diamond volume to be investigated was prepared using a dual beam focused ion beam ("FIB") to cut and extract a sufficiently thin section to allow for electron transmission. The sample was then examined in a transmission electron microscope ("TEM") at 200 kV.

The diamond grains (dark grey) are bonded to one another to form a continuous polycrystalline diamond matrix. The diamond volume also includes a continuous interstitial matrix (light grey) that is positioned between the diamond grains at positions spaced apart from the locations of diamond-to-diamond bonding. Note that the portion of the diamond volume from which the depicted sample has been taken from was unleached, such that none of the lead or lead alloy and catalyst material have been removed.

Figure 4:
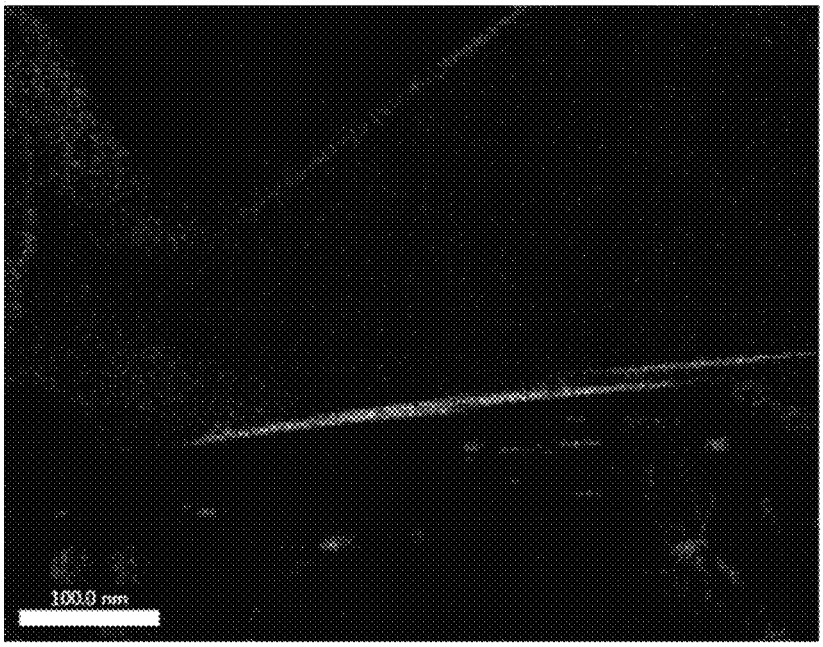
FIG. 4 is a plot of energy dispersive X-ray spectroscopy for cobalt in the region of the cutting element depicted in FIG. 3.
Figure 5:
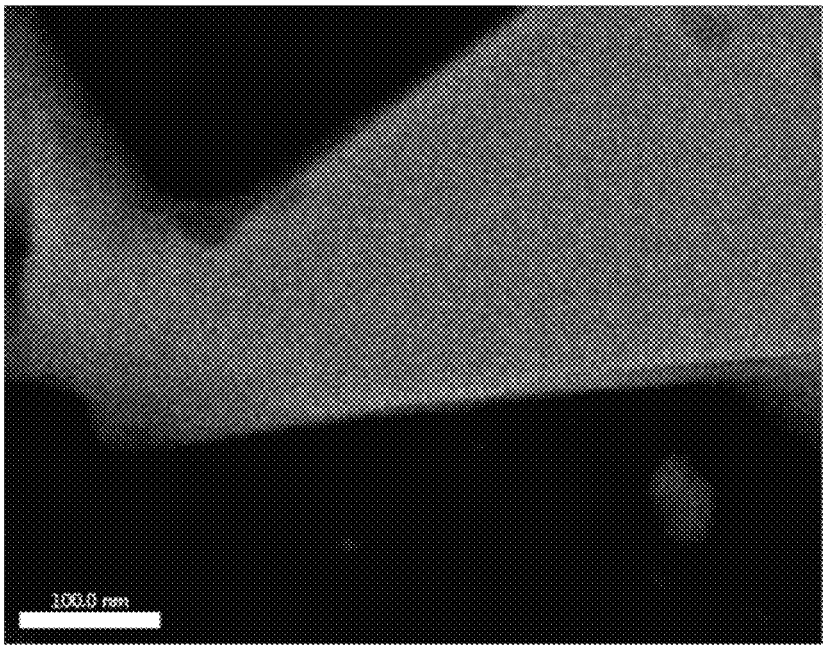
FIG. 5 is a plot of energy dispersive X-ray spectroscopy for lead in the region of the cutting element depicted in FIG. 3.

Referring to FIGS. 4 and 5, plots of energy dispersive X-ray spectroscopy data gathered from the location depicted in FIG. 3 are provided for lead in FIG. 4 and for catalyst material (here, cobalt) in FIG. 5. As can be seen in FIG. 4, a thin layer of lead or lead alloy coats portions of the diamond grains. In contrast, FIG. 5 depicts that cobalt fills the substantial majority of the remaining portions of the interstitial region.

The micrographs of FIGS. 4 and 5 indicate that there is a thin layer of lead or lead alloy that remains on some of the surfaces of the diamond grains following the HPHT process. The lead may be present along all of the surfaces of the diamond grain, but not visible in this sample configuration. Note that this lead or lead alloy remains present along the surfaces of the diamond grains following the HPHT process in which catalyst material is melted, molten catalyst material dissolves portions of the unbonded diamond particles, and the catalyst material solidifies and re-precipitates diamond at positions of diamond-to-diamond contact of the diamond grains in the presence of catalyst material.

In comparison to a conventional cutting element that does not include a lead or lead alloy addition, it is believe that catalyst material remains present along the surfaces of the diamond grains following subjecting the cutting element to a leaching process. Therefore, as compared to conventional cutting elements, cutting elements according to the present disclosure are believed to have lower catalyst content along the surfaces of the diamond grains. This reduction in catalyst content may reduce the total concentration of catalyst in the cutting element.

Further, the catalyst material positioned along surfaces of diamond grains of cutting elements according to the present disclosure may be functionally displaced by lead or lead alloy. Without being bound by theory, the lead or lead alloy does not have the same detrimental performance effects relating to the thermal stability of the diamond volumes on the cutting element when operating at elevated temperatures. Therefore, by incorporating the lead or lead alloy along the surfaces of the diamond grain (and thereby displacing the catalyst material), the thermal stability of cutting elements according to the present disclosure may be enhanced as compared to conventional cutting elements that do not include a lead or lead alloy addition.

In various embodiments, the lead or lead alloy and the catalyst material may be selected based on the interactive properties of the lead or lead alloy and the catalyst material. In one embodiment, the lead or lead alloy may exhibit a melting or liquidus temperature that is lower than the melting or liquidus temperature of the catalyst material. In one embodiment, the lead or lead alloy may be substantially immiscible with the catalyst material when both are in a liquid state. Such substantial immiscibility may be defined as less than about 10 at. % alloying of the materials. In one embodiment, the lead or a lead alloy may have greater than about 90 wt. % lead.

In one manufacturing process, cutting elements may be produced in a "single press" HPHT process in which diamond particles are bonded to one another and a substrate to form a cutting element having an integral diamond body with diamond grains bonded to one another in diamond-to-diamond bonds and interstitial regions between the diamond grains. Some of the interstitial regions include lead or lead alloy, catalyst material, hard metal, or combinations thereof. Portions of the diamond body are maintained in contact with a leaching agent that removes substantially all of the lead or lead alloy and catalyst material from a leached region positioned at the working surface of the cutting element and extending toward the substrate to a transition zone in which the leached region abuts the unleached region that is rich with lead or lead alloy and catalyst material.

Figure 6:
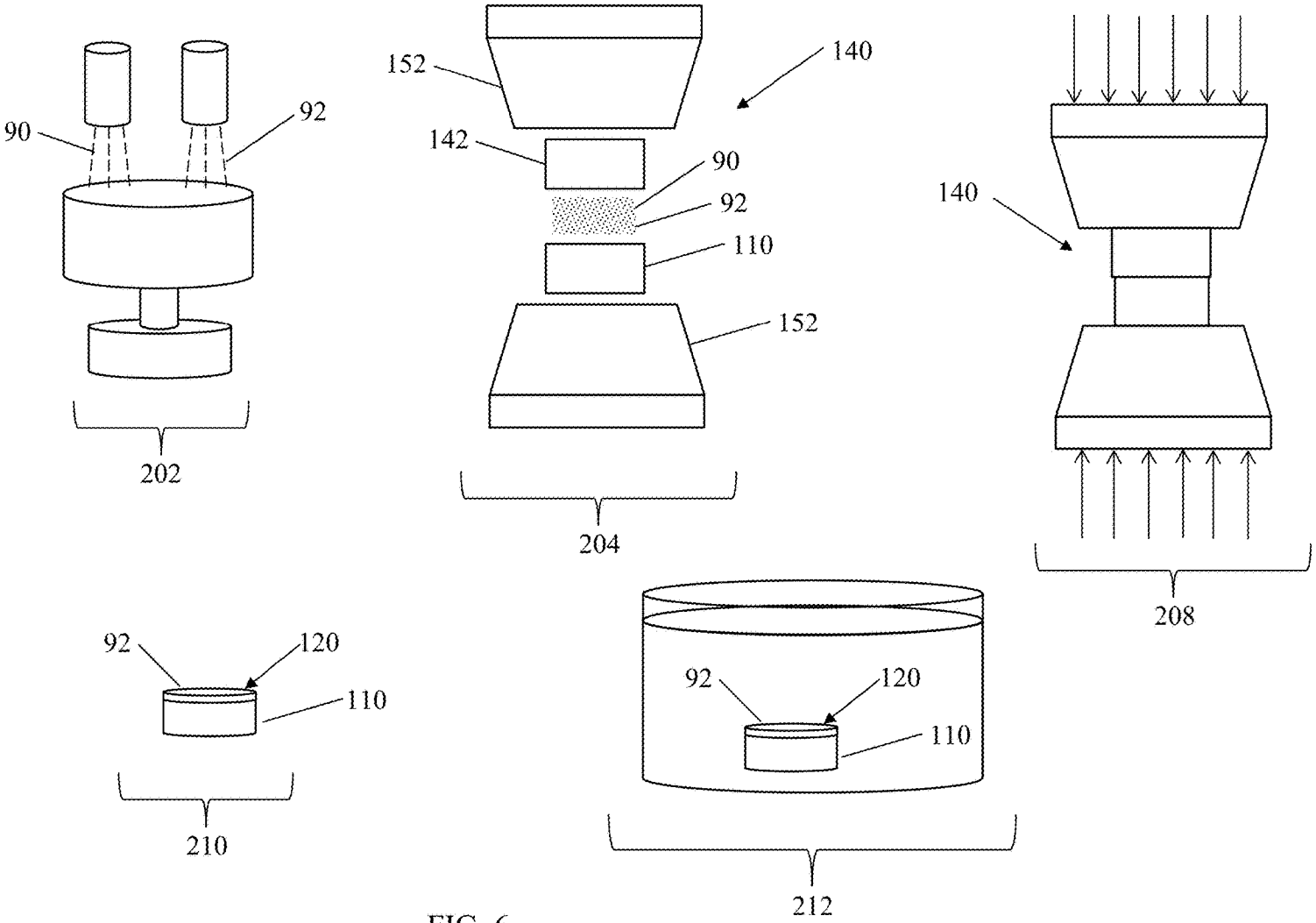
FIG. 6 is a schematic flow chart depicting a manufacturing process of a PCD cutting element.

Referring now to FIG. 6, a flowchart depicting a manufacturing procedure 200 is provided. Diamond particles 90 are mixed with the lead or lead alloy 92 in step 202. The size of the diamond particles 90 may be selected based on the desired mechanical properties of the polycrystalline diamond cutting element that is finally produced. It is generally believed that a decrease in grain size increases the abrasion resistance of the polycrystalline diamond cutting element, but decreases the toughness of the polycrystalline diamond cutting element. Further, it is generally believed that a decrease in grain size results in an increase in interstitial volume of the PCD compact. In one embodiment, the diamond particles 90 may have a single mode median volumetric particle size distribution (D50) in a range from about 10 μm to about 100 μm, for example having a D50 in a range from about 14 μm to about 50 μm, for example having a D50 of about 30 μm to about 32 μm. In other embodiments, the diamond particles 90 may have a D50 of about 14 μm, or about 17 μm, or about 30 μm, or about 32 μm. In other embodiments, the diamond particles 90 may have a multimodal particle size, wherein the diamond particles 90 are selected from two or more single mode populations having different values of D50, including multimodal distributions having two, three, or four different values of D50.

The lead or lead alloy 92 may be introduced to step 402 as a powder. In other embodiments, the lead or lead alloy 92 may be coated onto the unbonded diamond particles. The particle size of the lead or lead alloy may be in a range from about 0.005 μm to about 100 μm, for example being in a range from about 10 μm to about 50 μm.

The diamond particles 90 and the lead or lead alloy 92 may be dry mixed with one another using, for example, a commercial TURBULA® Shaker-Mixer available from Glen Mills, Inc. of Clifton, N.J. or an acoustic mixer available from Resodyn Acoustic Mixers, Inc. of Butte, Mont. to provide a generally uniform and well mixed combination. In other embodiments, the mixing particles may be placed inside a bag or container and held under vacuum or in a protective atmosphere during the blending process.

In other embodiments, the lead or lead alloy 92 may be positioned separately from the diamond particles 90. During the first HPHT process, the lead or lead alloy 92 may "sweep" from their original location and through the diamond particles 90, thereby positioning the lead or lead alloy 92 prior to sintering of the diamond particles 90. Subsequent to sweeping of the lead or lead alloy 92, the catalyst material 94 may be swept through the diamond particles 90 during the first HPHT process, thereby promoting formation of inter-diamond bonds between the diamond particles 90 and sintering of the diamond particles 90 to form the polycrystalline diamond body 120 of the polycrystalline diamond compact 80.

The diamond particles 90 and the lead or lead alloy 92 may be positioned within a cup 142 that is made of a refractory material, for example tantalum, niobium, vanadium, molybdenum, tungsten, or zirconium, as shown in step 204. The substrate 110 is positioned along an open end of the cup 142 and is optionally welded to the cup 142 to form cell assembly 140 that encloses diamond particles 90 and the lead or lead alloy 92. The substrate 110 may be selected from a variety of hard phase materials having metal carbides including, for example, cemented tungsten carbide, cemented tantalum carbide, or cemented titanium carbide. In one embodiment, the substrate 110 may include cemented tungsten carbide having free carbons, as described in U.S. Provisional Application Nos. 62/055,673, 62/055,677, and 62/055,679, the entire disclosures of which are hereby incorporated by reference. The substrate 110 may include a pre-determined quantity of catalyst material 94. Using a cemented tungsten carbide-cobalt system as an example, the cobalt is the catalyst material 94 that is infiltrated into the diamond particles 90 during the HPHT process. In other embodiments, the cell assembly 140 may include additional catalyst material (not shown) that is positioned between the substrate 110 and the diamond particles 90. In further other embodiments, the cell assembly 140 may include lead or lead alloy 92 that is positioned between the diamond particles 90 and the substrate 110 or between the diamond particles 90 and the additional catalyst material (not shown).

The cell assembly 140, which includes the diamond particles 90, the lead or lead alloy 92, and the substrate 110, is introduced to a press that is capable of and adapted to introduce ultra-high pressures and elevated temperatures to the cell assembly 140 in an HPHT process, as shown in step 208. The press type may be a belt press, a cubic press, or other suitable presses. The pressures and temperatures of the HPHT process that are introduced to the cell assembly 140 are transferred to contents of the cell assembly 140. In particular, the HPHT process introduces pressure and temperature conditions to the diamond particles 90 at which diamond is stable and inter-diamond bonds form. The temperature of the HPHT process may be at least about 1000° C. (e.g., about 1200° C. to about 1800° C., or about 1300° C. to about 1600° C.) and the pressure of the HPHT process may be at least 4.0 GPa (e.g., about 4.0 GPa to about 12.0 GPa, or about 5.0 GPa to about 10 GPa, or about 5.0 GPa to about 8.0 GPa) for a time sufficient for adjacent diamond particles 90 to bond to one another, thereby forming an integral PCD compact having the polycrystalline diamond body 120 and the substrate 110 that are bonded to one another.

An integral PCD compact 82 having a polycrystalline diamond body 120 that is bonded to the substrate 110 may be recovered from the HPHT cell, as depicted in step 210. The introduction of the lead or lead alloy 92 to the polycrystalline diamond body 120 prior to the HPHT process may result in a reduction of catalyst material 94 that is present in the polycrystalline diamond body 120 following the HPHT process and prior to initiation of any subsequent leaching process. As compared to conventional cutting elements that are produced without the introduction of the lead or lead alloy 92, unleached diamond bodies 120 produced according to the present disclosure may contain, for example, about 10% less catalyst material 94 when evaluated prior to leaching.

The polycrystalline diamond body 120 may undergo a leaching process in which the catalyst material is removed from the polycrystalline diamond body 120. In one example of a leaching process, the polycrystalline diamond body 120 is introduced to a leaching agent of an acid bath to remove the remaining substrate 110 from the polycrystalline diamond body 120, as shown in step 212. The leaching process may also remove lead or lead alloy 92 and catalyst material 94 from the polycrystalline diamond body 120 that is accessible to the acid. Suitable acids may be selected based on the solubility of the lead or lead alloy 92 and the catalyst material 94 that is present in the polycrystalline diamond body. Examples of such acids including, for example and without limitation, ferric chloride, cupric chloride, nitric acid, hydrochloric acid, hydrofluoric acid, aqua regia, or solutions or mixtures thereof. The acid bath may be maintained at an pre-selected temperature to modify the rate of removal of the lead or lead alloy 92 and the catalyst material 94 from the polycrystalline diamond body 120, including being in a temperature range from about 10° C. to about the boiling point of the leaching agent. In some embodiments, the acid bath may be maintained at elevated pressures that increase the liquid boiling temperature and thus allow the use of elevated temperatures, for example being at a temperature of greater than the boiling point of the leaching agent at atmospheric pressure. The polycrystalline diamond body 120 may be subjected to the leaching process for a time sufficient to remove the desired quantity of lead or lead alloy 92 and catalyst material 94 from the polycrystalline diamond body. The polycrystalline diamond body 120 may be subjected to the leaching process for a time that ranges from about one hour to about one month, including ranging from about one day to about 7 days.

In some embodiments, the polycrystalline diamond body 120 may be maintained in the leaching process until the polycrystalline diamond body 120 is at least partially leached. In polycrystalline diamond bodies 120 that are partially leached, the exterior regions of the polycrystalline diamond bodies 120 that are positioned along the outer surfaces of the polycrystalline diamond bodies 120 have the accessible interstitial regions depleted of lead or lead alloy 92 and/or catalyst material 94, while the interior regions of the polycrystalline diamond bodies 120 are rich with lead or lead alloy 92 and/or catalyst material 94. In such partially leached polycrystalline diamond bodies 120, all of the accessible interstitial regions between the diamond grains may be fully depleted of lead or lead alloy 92 and/or catalyst material 94. In some embodiments, hard metal that is introduced to the polycrystalline diamond body 120 during the HPHT process may remain in the accessible interstitial regions.

In some embodiments, the extent of the leaching may be monitored by weighing the polycrystalline diamond body 120 after a pre-defined period of time. As the change in the weight loss of the polycrystalline diamond body 120 approaches a threshold value (for example, 10% loss of the unleached polycrystalline diamond body 120), the polycrystalline diamond body 120 may be considered to be completely leached. Because the polycrystalline diamond body 120 is leached without the substrate 110, the leach fronts may extend from opposing sides of the polycrystalline diamond body 120 and from the perimeter surface of the polycrystalline diamond body 120. When the leach fronts from the opposing sides of the polycrystalline diamond body 120 meet, the polycrystalline diamond body 120 may be considered to be completely leached. In some embodiments, the extent of leaching may be monitored by the loss of density of the diamond body.

In some embodiments, an unleached polycrystalline diamond body may have lead or lead alloy 92 and catalyst material 94 at greater than about 4 vol. % of the polycrystalline diamond body 120, including being from about 4 vol. % to about 15 vol. %. In comparison, a completely leached portion of a polycrystalline diamond body 120 may have lead or lead alloy 92 and catalyst material 94 that is less than about 80% less than the unleached polycrystalline diamond body 120, for example being in a range from about 60% to about 80% less than the unleached polycrystalline diamond body 120. A completely leached polycrystalline diamond body 120 may have lead or lead alloy 92 and catalyst material 94 being from about 0.25 vol. % to about 6 vol. %, for example, being from about 0.2 vol. % to about 1 vol. %. In general, the extent of loss of lead or lead alloy and catalyst material in a completely leached polycrystalline diamond body 120 is determined the material structure and composition, for example by the precursor diamond grain size and the particle size distribution.

As discussed above, the introduction of the lead or lead alloy to the polycrystalline diamond body 120 reduces the concentration of the catalyst material 94 in the polycrystalline diamond body 120 prior to any leaching process. Further, subsequent to leaching regions of the polycrystalline diamond body 120, the introduction of the lead or lead alloy 92 to the polycrystalline diamond body 120 also reduces the concentration of the catalyst material 94 that remains present in the trapped interstitial volumes of the polycrystalline diamond body 120 of the leached region of the polycrystalline diamond body 120. As compared to conventional cutting elements that are produced without the introduction of the lead or lead alloy 92, diamond bodies 120 produced according to the present disclosure contain from about 30 vol. % to about 90 vol. % less catalyst material 94 following complete leaching of both of the compared diamond bodies.

The introduction of the lead or lead alloy 92 to the polycrystalline diamond body 120 may also increase the leaching rate of the polycrystalline diamond body 120, such that the duration of time required to obtain complete leaching of the polycrystalline diamond body 120 is reduced as compared to conventionally produced diamond bodies. For example, complete leaching of the polycrystalline diamond body 120 having lead or lead alloy 92 according to the present disclosure may be obtained from about 30% to about 60% less time as compared to conventional cutting elements that are produced without the introduction of the lead or lead alloy 92. In one example, when evaluated after 7 days of introduction to the leaching process, polycrystalline diamond bodies 120 produced according to the present disclosure exhibited from about 40% to about 70% more mass loss than conventional PCD compacts.

Following substantially complete leaching of the polycrystalline diamond body 120, the polycrystalline diamond body 120 continues to exhibit non-diamond components that are present in the trapped interstitial regions of the polycrystalline diamond body 120 that are positioned between bonded diamond grains in at least detectable amounts. However, the reduction of the non-diamond components (including catalyst material 94) in the leaching process accessible interstitial regions reduces the content of catalyst material 94 in the polycrystalline diamond body 120 and increases the thermal stability of the polycrystalline diamond body 120.

Following formation of the integral PCD compact 82, the PCD compact 82 may be processed through a variety of finishing operations to remove excess material from the PCD compact 82 and configure the PCD compact 82 for use by an end user, including formation of a cutting element 84, as shown in step 418. Such finishing operations may include, for example, grinding and polishing the outside diameter of the PCD compact 82, cutting, grinding, lapping, and polishing the opposing faces (both the support-substrate-side face and the diamond-body-side face) of the PCD compact 82, and grinding and lapping a chamfer into the PCD compact 82 between the diamond-body-side face and the outer diameter of the PCD compact 82.

In an alternative manufacturing process, cutting elements may be produced in a "double press" HPHT process in which diamond particles are bonded to one another to form the diamond body in a first HPHT process, the diamond body is fully leached of lead or lead alloy and catalyst material from the interstitial regions between the diamond grains, and the diamond body is attached to a substrate in a second HPHT process. The diamond particles may first be subjected to a first HPHT process to form a polycrystalline diamond compact having a polycrystalline diamond body that is formed through sintering with a catalyst material source. In one embodiment, the catalyst material source is provided integrally with a substrate (a first substrate). Substantially all of the substrate is removed from the polycrystalline diamond body, the polycrystalline diamond body is machined to a desired shape, and the polycrystalline diamond body is leached to remove substantially all of the accessible lead or lead alloy and catalyst material from the interstitial regions of the polycrystalline diamond body. The leached polycrystalline diamond body is subsequently cleaned of leaching debris and bonded to a substrate in a second HPHT process, thus forming a PCD compact. This PCD compact is subsequently finished according to conventionally known procedures to the final shape desirable of the PCD cutting elements for the end user application.

Figure 7:
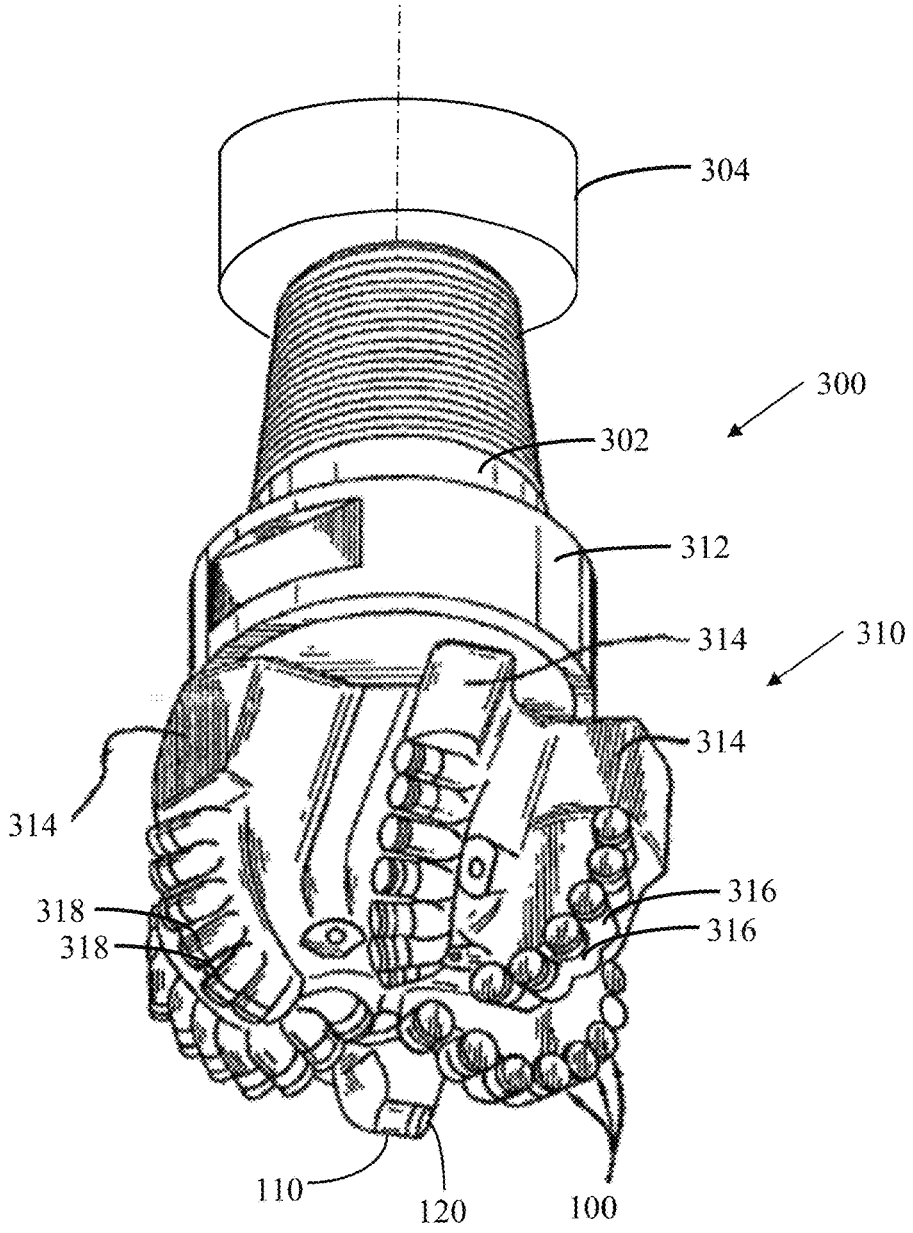
FIG. 7 is a schematic perspective view of a drill bit having a plurality of PCD cutting elements according to one or more embodiments shown or described herein.

Referring now to FIG. 7, a plurality of PCD cutting elements 100 according to the present disclosure may be installed in a drill bit 310, as conventionally known, to perform a downhole drilling operation. The drill bit 310 may be positioned on a drilling assembly 300 that includes a drilling motor 302 that applies torque to the drill bit 310 and an axial drive mechanism 304 that is coupled to the drilling assembly for moving the drilling assembly 300 through a borehole and operable to modify the axial force applied by the drill bit 310 in the borehole. Force applied to the drill bit 310 is referred to as "Weight on Bit" ("WOB"). The drilling assembly 300 may also include a steering mechanism that modifies the axial orientation of the drill assembly 300, such that the drill bit 310 can be positioned for non-linear downhole drilling.

The drill bit 310 includes a stationary portion 312 and a material removal portion 314. The material removal portion 314 may rotate relative to the stationary portion 312. Torque applied by the drilling motor 302 rotates the material removal portion 314 relative to the stationary portion 312. A plurality of PCD cutting elements 100 according to the present disclosure are coupled to the material removal portion 314. The plurality of PCD cutting elements 100 may be coupled to the material removal portion 314 by a variety of conventionally known methods, including attaching the plurality of PCD cutting elements 100 to a corresponding plurality of shanks 316 that are coupled to the material removal portion 314. The PCD cutting elements 100 may be coupled to the plurality of shanks 316 by a variety of methods, including, for example, brazing, adhesive bonding, or mechanical affixation. In embodiments in which the PCD cutting elements 100 are brazed to the shanks 316 with a braze filler 318, at least a portion of the shanks 316, the braze filler 318, and at least a portion of the substrate 110 of the PCD cutting elements 100 is heated to an elevated temperature while in contact with one another. As the components decrease in temperature, the braze filler 318 solidifies and forms a bond between the substrate 110 of the PCD cutting elements 100 and the shanks 316 of the material removal portion 314. In one embodiment, the brazing filler 318 has a melting temperature that is greater than a melting temperature of the lead or lead alloy of the polycrystalline diamond body 120 at ambient pressure conditions. In another embodiment, the brazing filler 318 has a melting temperature that is less than the catalyst material 94 of the polycrystalline diamond body 120 at ambient pressure conditions. In yet another embodiment, the brazing filler 318 has a melting temperature that is less than the liquidus temperature of the catalyst material of the polycrystalline diamond body at ambient pressure conditions.

When the drill bit 310 is positioned in the borehole, the material removal portion 314 rotates about the stationary portion 312 to reposition the PCD cutting elements 100 relative to the borehole, thereby removing surrounding material from the borehole. Force is applied to the drill bit 310 by the axial drive mechanism 304 in generally the axial orientation of the drill bit 310. The axial drive mechanism 304 may increase the WOB, thereby increasing the contact force between the PCD cutting elements 100 and the material of the borehole. As the material removal portion 314 of the drill bit 310 continues to rotate and WOB is maintained on the drill bit 310, the PCD cutting elements 100 abrade material of the borehole, and continue the path of the borehole in an orientation that generally corresponds to the axial direction of the drill bit 310.

It should now be understood that PCD cutting elements according to the present disclosure include a lead or lead alloy addition to the diamond volume that is positioned within interstitial regions between adjacent diamond grains. The lead or lead alloy may reduce contact between the diamond grains and a catalyst material that the diamond grains dissolve into when the catalyst material is molten. By preserving spacing between the catalyst material and the diamond grains, the PCD cutting element may exhibit improved performance at elevated temperatures as compared to conventional PCD cutting elements.

The invention claimed is:

1. A cutting element, comprising:

a substrate comprising a metal carbide; and a polycrystalline diamond body bonded to the substrate, the polycrystalline diamond body comprising a plurality of diamond grains bonded to adjacent diamond grains by diamond-to-diamond bonds and a plurality of interstitial regions positioned between adjacent diamond grains, wherein at least a portion of the plurality of interstitial regions comprise lead or lead alloy wherein lead is present in an amount of at least about 90 wt. % of the lead alloy, wherein the lead or lead alloy comprises of 0.1 vol. % to about 5.0 vol. % of the diamond body, and wherein at least a portion of the plurality of interstitial regions comprise lead or lead alloy that coat portions of the adjacent diamond grains such that the lead or lead alloy reduces contact between the diamond and a catalyst material.

2. The cutting element of claim 1, wherein at least a portion of the plurality of interstitial regions are substantially free of lead or lead alloy and catalyst material.

3. The cutting element of claim 2, wherein the portion of the plurality of interstitial regions that are substantially free of lead or lead alloy and catalyst material are subject to a leaching process.

4. The cutting element of claim 1, wherein portions of the catalyst material that is positioned within the interstitial regions are spaced apart from the diamond grains by the lead or lead alloy.

5. The cutting element of claim 1, wherein the diamond grains have higher wettability with the catalyst material than the lead or lead alloy when both are molten.

6. The cutting element of claim 1, wherein when the lead or lead alloy and the catalyst material are held at a temperature above the melting or liquidus temperature of the catalyst material, the lead or lead alloy has a lower viscosity than the catalyst material.

7. A polycrystalline diamond volume comprising:

a plurality of diamond grains bonded to adjacent diamond grains by diamond-to-diamond bonds forming a continuous diamond matrix and a plurality of interstitial regions positioned between adjacent diamond grains and forming a continuous interstitial matrix, wherein at least a portion of the continuous interstitial matrix comprises catalyst material comprises a range of from about 4.5 vol. % to about 6.0 vol. % of the diamond body, said catalyst material is separated from the diamond grains by lead or lead alloy wherein lead is present in an amount of at least about 90 wt. % of the lead alloy and wherein the lead or lead alloy comprises 0.33 vol. % to about 1.5 vol. % of the diamond body, such that the lead or lead alloy reduces contact between the diamond and the catalyst material.

8. The cutting element of claim 7, wherein at least a portion of the plurality of interstitial regions are substantially free of lead or lead alloy and the catalyst material.

9. The cutting element of claim 8, wherein the portion of the plurality of interstitial regions that are substantially free of lead or lead alloy and catalyst material were subjected to a leaching process.

10. The cutting element of claim 7, wherein the diamond grains have higher wettability with the catalyst material than the lead or lead alloy when both are molten.

11. A cutting element comprising:

a substrate comprising a metal carbide; and a polycrystalline diamond body bonded to the substrate, the polycrystalline diamond body comprising a plurality of diamond grains bonded to adjacent diamond grains by diamond-to-diamond bonds forming a continuous diamond matrix and a plurality of interstitial regions positioned between adjacent diamond grains and forming a continuous interstitial matrix, wherein at least a portion of the continuous interstitial matrix comprises catalyst material wherein the catalyst material comprises a range of from about 0.1 vol. % to about 30.0 vol. % of the diamond body, the catalyst material is separated from the diamond grains by lead or lead alloy wherein lead is present in an amount of at least about 90 wt. % of the lead alloy and wherein the lead or lead alloy comprises of 0.1 vol. % to about 5.0 vol. % of the diamond body such that the lead or lead alloy reduces contact between the diamond and the catalyst material.

12. The cutting element of claim 11, wherein at least a portion of the plurality of interstitial regions are substantially free of lead or lead alloy and catalyst material.

13. The cutting element of claim 11, wherein the portion of the plurality of interstitial regions that are substantially free of lead or lead alloy and catalyst material are subject to a leaching process.

14. The cutting element of claim 11, wherein portions of the catalyst material that is positioned within the interstitial regions are spaced apart from the diamond grains by the lead or lead alloy.

15. The cutting element of claim 11, wherein the diamond grains have higher wettability with the catalyst material than the lead or lead alloy when both are molten.

16. A drill bit comprising:

a material removal portion having a plurality of shanks, the material removal portion having an axis of rotation that is relative to a base portion; and at least one cutting element that is bonded to the material removal portion at one of the plurality of shanks, the cutting elements comprising:

a substrate comprising a metal carbide; and a polycrystalline diamond body bonded to the substrate, the polycrystalline diamond body comprising a plurality of diamond grains bonded to adjacent diamond grains by diamond-to-diamond bonds and a plurality of interstitial regions positioned between adjacent diamond grains, wherein at least a portion of the plurality of interstitial regions comprise lead or lead alloy wherein lead is present in an amount of at least about 90 wt. % of the lead alloy wherein the lead or lead alloy comprises 0.33 vol. % to about 1.5 vol. % of the diamond body, and wherein at least a portion of the plurality of interstitial regions comprise lead or lead alloy that coat portions of the adjacent diamond grains such that the lead or lead alloy reduces contact between the diamond and a catalyst material.

17. The drill bit of claim 16, wherein at least a portion of the plurality of interstitial regions are substantially free of lead or lead alloy and catalyst material.

18. The drill bit of claim 17, wherein the portion of the plurality of interstitial regions that are substantially free of lead or lead alloy and catalyst material are subject to a leaching process.

19. The drill bit of claim 16, wherein portions of the catalyst material that is positioned within the interstitial regions are spaced apart from the diamond grains by the lead or lead alloy.

20. The drill bit of claim 16, wherein the diamond grains have higher wettability with the catalyst material than the lead or lead alloy when both are molten.

21. A cutting element, comprising:

a substrate comprising a metal carbide; and a polycrystalline diamond body bonded to the substrate, the polycrystalline diamond body comprising a plurality of diamond grains bonded to adjacent diamond grains by diamond-to-diamond bonds and a plurality of interstitial regions positioned between adjacent diamond grains, wherein at least a portion of the plurality of interstitial regions comprise lead wherein lead is present in an amount of at least about 90 wt. % of a lead alloy;

wherein the lead alloy comprises of 0.1 vol. % to about 5.0 vol. % of the diamond body, and wherein at least a portion of the plurality of interstitial regions comprise lead alloy that coats portions of the adjacent diamond grains such that the lead alloy reduces contact between the diamond and the catalyst material.

* * * * *